United States Patent [19]

Chang

[11] Patent Number: 4,948,172

[45] Date of Patent: Aug. 14, 1990

[54] COMBINED CLIP BOARD AND PEN HOLDER

[76] Inventor: Shih-Ho Chang, No. 2-12, Chang-Lu Rd., Changhau City, Taiwan

[21] Appl. No.: 297,963

[22] Filed: Jan. 17, 1989

[51] Int. Cl.[5] ..... B42F 9/00

[52] U.S. Cl. ..... 281/45; 281/30

[58] Field of Search ..... 281/30, 42, 45

[56] References Cited

U.S. PATENT DOCUMENTS

| | | | |
|---|---|---|---|
| 3,564,668 | 2/1971 | Kirk | 281/30 |
| 4,306,737 | 12/1981 | Errichiello | 281/30 |
| 4,375,296 | 3/1983 | Chang | 281/45 |

FOREIGN PATENT DOCUMENTS

| | | | |
|---|---|---|---|
| 20316 | of 1906 | United Kingdom | 281/30 |

*Primary Examiner*—Paul A. Bell

*Attorney, Agent, or Firm*—Ladas & Parry

[57] ABSTRACT

A clip board has an integrally formed elongated clip mounting member which has a groove means extending longitudinally therein. A U-shaped plate insert means is inserted in the groove means and opened upward. A bent rod has an engaging portion to engage with the board, two bent arm portions on two sides of the engaging portion, and two opposing end portions extending inwardly from the arm portions. The opposing end portions are received in the groove means with two coil springs respectively provided thereon. The coil springs have engaging portions which threads through the board and is bent to be engaged with the bottom side of the board. The upward extending portions of the insert means confines a channel above the coil springs to clamp therebetween releaseably a pen or the like.

1 Claim, 3 Drawing Sheets

COMBINED CLIP BOARD AND PEN HOLDER

BACKGROUND OF THE INVENTION

This invention relates to a clip board and particularly to a clip board which incorporates a pen holder.

Various forms of clip boards exist in the art. U.S. Pat. No. 4,375,296 which is owned by the inventor of this application discloses a clip board shown in FIG. 1. The clip board includes a board 1 with a clip mount 2 formed thereon and having two grooves which receive two inverted U-shaped insert members 3. A bent rod 4 which has two opposing bent end portions (not shown) is attached to the clip mount 2 in such a way that the bent end portions are received in the spaces confined by the grooves and the insert members and that the engaging ends of two coil springs sleeved on the bent end portions are threaded through the board and engaged with the back of the board. Such a clip board is advantageous because the assembly thereof can be accomplished simply without using any fasteners. However, there is a drawback in that no clamping means is provided for holding a pen or the like.

SUMMARY OF THE INVENTION

An object of the invention is to provide a clip board of the type described above with a holding member which can hold a pen, a pencil or the like with a clamping action.

According to the present invention, a clip board comprises a board, an elongated clip mounting member integrally formed on and projecting from the top side thereof adjacent to one of the transverse edges thereof, the clip mounting member having a groove means which opens at a top side thereof and which extends longitudinally therein, an insert means which is in the form of a U-shaped plate inserted in the groove means, the insert means having two upward extending portions which are opened upward, a bent rod clip having an engaging portion to engage with the board, two bent arm portions on two sides of the engaging portion, and two opposing end portions extending inwardly from the arm portions, the opposing end portions being received in the groove means, and two coil springs respectively provided around the opposing end portions, each of the coil springs having an engaging portion which is threaded through the board and is then bent to be engaged with the bottom side of the board, the upward extending portions of the insert means confining a channel above the coil springs and being adapted to clamp therebetween releaseably a pencil or the like.

In one aspect of the invention, the groove means includes two spaced apart grooves, and the insert means includes two U-shaped plate members respectively inserted in the grooves.

The present exemplary preferred embodiment will be described in detail with reference to the accompanying drawings, in which:

DETAILED DESCRIPTION OF THE PREFERRED EMBODIMENT

Figure 1:
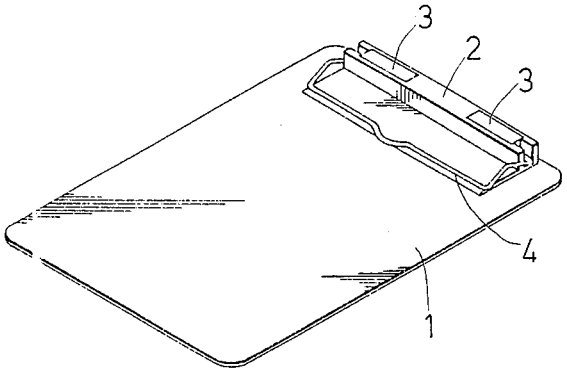
PRIOR ART FIG. 1
FIG. 1 shows a clip board in the prior art.
Figure 2:
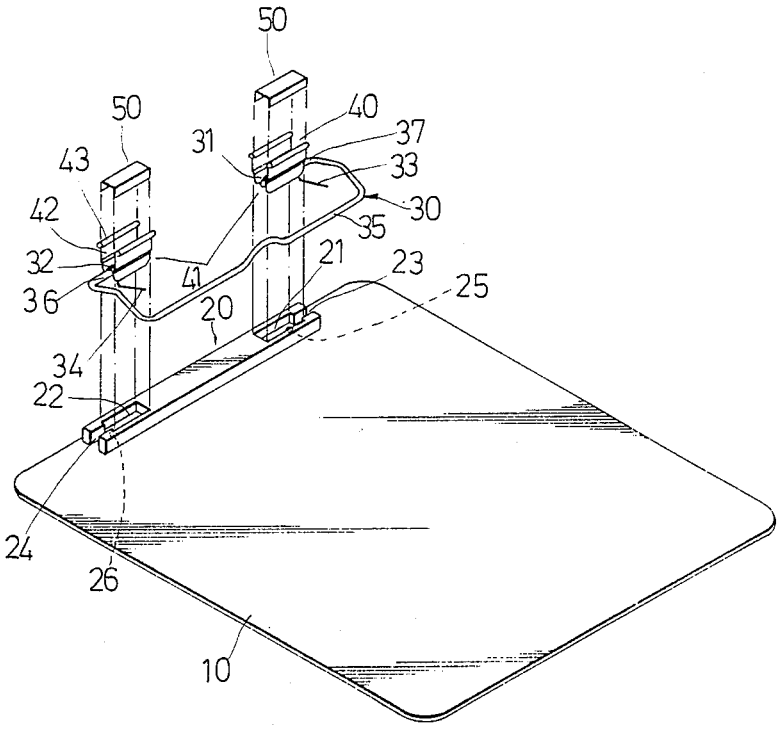
FIG. 2 is an exploded view of the combined clip board and pen holder according to the present invention.
Figure 3:
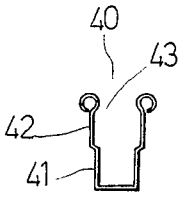
FIGS. 3 and 4 show the insert member of the present invention.
Figure 4:
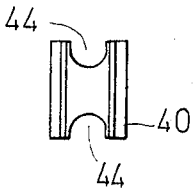
Figure 5:
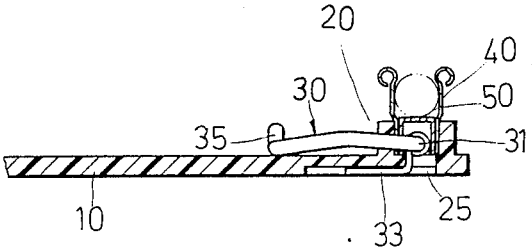
FIG. 5 is a sectional view of the combined clip board and pencil holder of FIG. 2.

Referring to FIGS. 3, 4 and 5, a preferred embodiment of the combined clip board and pen holder of the present invention is shown, including a backing board 10 which has an elongated clip mounting member 20 formed integrally thereon. The clip mounting member 20 is provided with two spaced apart grooves 21 and 22 which are opened at the top side thereof. Two restricted openings 23 and 24 are provided at two ends of the clip mounting member 20 and communicated with the grooves 21 and 22 respectively. Two holes 25 and 26 are provided in the board 10.

Two metal plate insert members 40 which are in the form of a U-shaped plate have their lower portions 41 respectively inserted snugly in the grooves 21 and 22 of the clip mounting member 20 and are opened upward. As shown in FIGS. 4 and 5, each insert member 40 has a base portion which is provided with two opposite notches 44. A clip 30 in the form of a bent rod is mounted on the clip mounting member 20. The clip 30 has a board engaging portion 35 to engage with the top surface of the board 10, and two opposing bent end portions 36 and 37 extending into the insert members 40 passing through the restricted openings 23 and 24. Two coil springs 31 and 32 are sleeved around the opposing bent end portions 36 and 37 and have two engaging end portions 33 and 34 which are respectively threaded through the holes 25 and 26 of the board, passing through the notches 44 of the insert members. The engaging end portions 33 and 34 turn back to engage with the bottom side of the board 10, thereby mounting the clip member 30 and the springs 31 and 32 to the clip mounting member 20. The springs 31 and 32 bias normally the engaging clip portion 35 to abut with the top side of the board. Two inverted U-shaped cover plates 50 are respectively inserted in the insert members 40 above the coil springs 31 and 32.

The upward extending portions 42 above the cover plates are opened upward and confine two aligned channels above the cover plates 50 for receiving a pen or the like. Since the insert members 40 have a measure of resiliency, the upward extending portions 42 provides a clamping effect for holding the pencil or the like. Preferably, the upper ends of the upward extending portions 42 of the insert members 40 are provided with rolled edges 43 so as to prevent the pencil or the like from being released easily.

With the invention thus explained, it is apparent that various modifications and variations can be made without departing from the scope of the present invention. It is therefore intended that the invention be limited as indicated in the appended claims.

What I claim is:

1. A clip board comprising a board having a top side, a bottom side and two opposing transverse sides, an elongated clip mounting member integrally formed on and projecting from said top side adjacent to one of said transverse sides, said clip mounting member having a groove means which opens at a top side thereof and which extends longitudinally therein, an insert means which is in the form of a U-shaped plate inserted in said groove means, said insert means having two upward extending portions which are open upward, a bend rod clip having a board engaging portion to engage with said board, two bend arm portions on two sides of said engaging portions, and two opposing end portions extending inwardly from said arm portions, said opposing end portions being received in said groove means, two coil springs respectively provided around said opposing end portions, each of said coil springs having a board engaging portion which is threaded through said board and is then bent to be engaged with said bottom side of said board, said upward extending portions of said insert means confining a channel means above said coil springs and being adapted to clamp therebetween releaseably a pencil or the like, and a cover means inserted in said insert means above said coil springs, said cover means cooperating with said upward extending portions of said insert means to confine said channel means.

* * * * *